United States Patent [19]

La Grotteria

[11] Patent Number: 4,618,992

[45] Date of Patent: Oct. 21, 1986

[54] BAG CONVERTABLE TO PLACE MAT

[76] Inventor: Julius K. La Grotteria, 607 E. Lee Dr., Santa Maria, Calif. 93454

[21] Appl. No.: 678,789

[22] Filed: Dec. 6, 1984

[51] Int. Cl.[4] ..... B65D 33/00; B65D 30/10

[52] U.S. Cl. ..... 383/4; 383/127; 206/604; 206/620; 206/632; 229/87 F; 229/DIG. 13

[58] Field of Search ..... 383/4, 127; 206/604, 206/620, 627, 632; 229/DIG. 13, 13, 87 F

[56] References Cited

U.S. PATENT DOCUMENTS

| | | | |
|---|---|---|---|
| 1,881,890 | 10/1932 | Offenbacher | 206/632 X |
| 2,831,624 | 4/1958 | Lever | 383/4 |
| 3,099,593 | 7/1963 | Syracuse | 206/620 X |
| 3,594,177 | 7/1971 | McGowan | 229/87 F X |
| 4,292,332 | 9/1981 | McHam | 383/103 X |
| 4,484,350 | 11/1984 | Gordon | 383/4 |

FOREIGN PATENT DOCUMENTS

| | | | |
|---|---|---|---|
| 180443 | 5/1970 | Fed. Rep. of Germany | 383/127 |

*Primary Examiner*—William Price
*Assistant Examiner*—Sue A. Weaver
*Attorney, Agent, or Firm*—Daniel C. McKown

[57] ABSTRACT

A paper bag for containing take-out food from a restaurant can be converted by the customer into a flat place mat. As supplied to the restaurant, the bag includes perforations which serve to mark and guide the direction of tearing. A first line of tearing perforations extends circumferentially around the bag near its closed end. A second line of tearing perforations extends from the open end of the bag to the first line of tearing perforations. In a first embodiment, the bag has a rectangular bottom, and in a second embodiment, the bottom of the bag is trough-shaped.

1 Claim, 4 Drawing Figures

FIG. 1
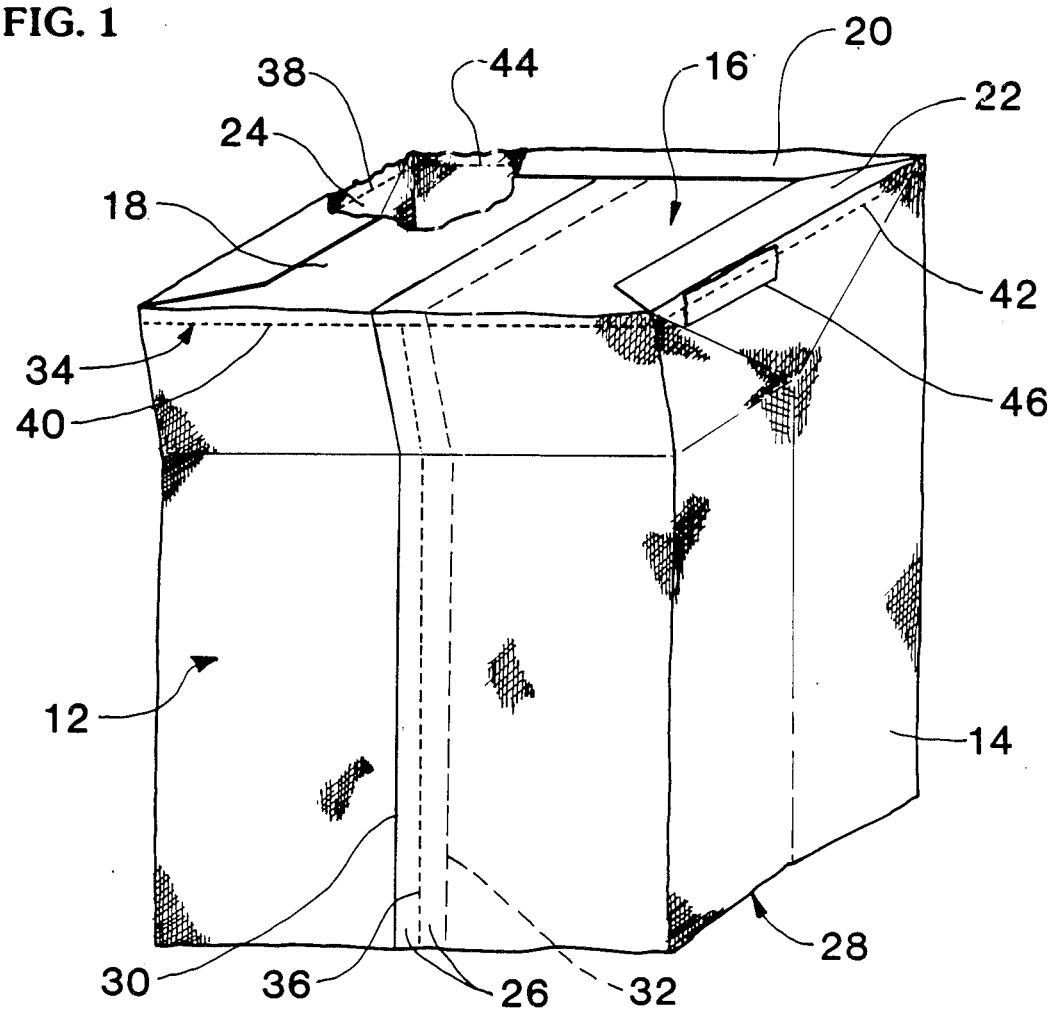
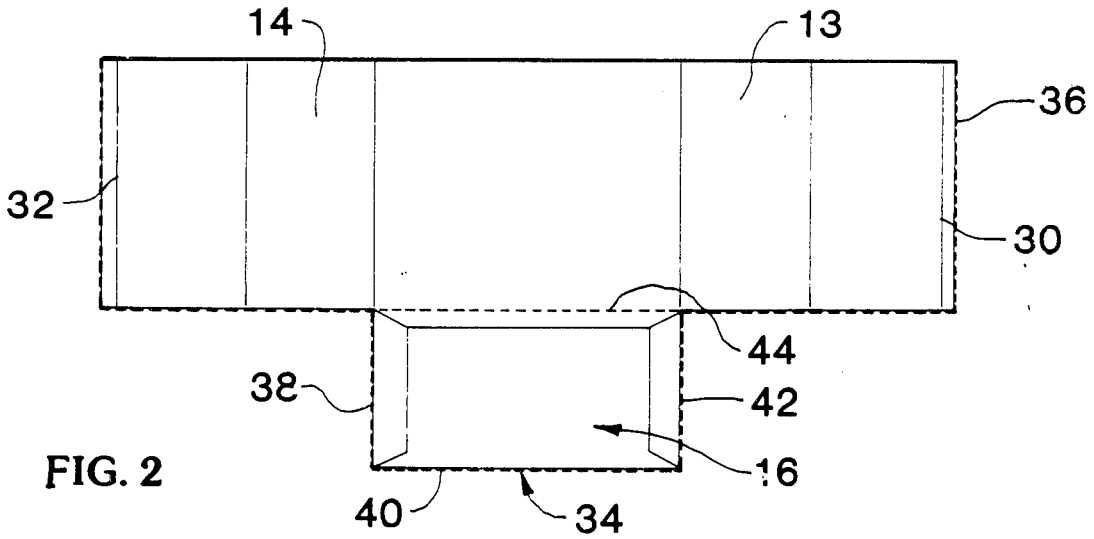
FIG. 2

BAG CONVERTABLE TO PLACE MAT

BACKGROUND OF THE INVENTION

1. Field of the Invention

The present invention is in the field of containers and more specifically relates to a bag having perforations in prescribed locations to facilitate tearing of the bag after it has been used so that the bag will be reduced to a flat sheet usable as a place mat. The bag would be used in the fast-food industry for packaging take-out foods, such as sandwiches. Upon reaching his destination, the user will remove the food from the bag, then tear the bag along the lines of perforation, thereby rendering the bag suitable for use as a place mat.

2. The Prior Art

Several patents have been found that relate to dual-purpose bags; some of these involve the use of perforations. However, the present invention has a unique structure that allows it to be distinguished from the earlier inventions.

In U.S. Pat. No. 3,160,343 issued Dec. 8, 1964 to Schantzer, there is disclosed a paper bag that is formed by folding and stitching a sheet of gift-wrapping paper. A line of holes or perforations along certain edges of the sheet allows a ribbon to be chain-stitched through the holes to secure the edges together. The ribbon can then be removed to permit the sheet to be flattened, prior to its use as gift-wrapping paper. The perforations are not used to facilitate tearing, and the bag is not torn in the process of converting it to a flat sheet.

In U.S. Pat. No. 2,853,710 issued Sept. 30, 1958 to Swann, there is shown a paper shopping bag that has perforations that facilitate tearing the bag in such a way that it is converted into a costume such as a child might wear. The pattern of perforations used is entirely different from the pattern of perforations used the present invention.

In U.S. Pat. No. 2,000,242 issued May 7, 1935 to Manning, there is shown a paper bag that is imprinted with a face so that it can be used as a mask. However, no perforations are provided.

SUMMARY OF THE INVENTION

It is an object of the present invention to provide a bag that can be converted to use as a place mat by tearing the bag along lines of tearing perforations.

Another object of the invention is to provide a bag that is convertable to a place mat but that retains as much strength as possible while used as a bag.

In a first preferred embodiment of the present invention, usable with a bag having a flat rectangular end and four side panels, a line of tearing perforations extends from the open end of the bag almost to the bottom of the bag where it intersects a second line of perforations that extends along or adjacent to the lower ends of the side panels.

A second preferred embodiment of the invention is usable with another popular type of bag that has a different construction. This second type of bag is formed from a tube of paper or other material by folding one end of the tube back upon itself. As a result, the bag has a trough-shaped bottom instead of a flat bottom. In the embodiment of the invention used for that type of bag, a first line of tearing perforations is formed lengthwise of the bag from the open end to a point near the bottom of the bag. At that point, the first line of perforations intersect a second line of tearing perforations that extends laterally across the bag near its closed end.

The novel features which are believed to be characteristic of the invention, both as to organization and method of operation, together with further objects and advantages thereof, will be better understood from the following description considered in connection with the accompanying drawings in which several preferred embodiments of the invention are illustrated by way of example. It is to be expressly understood, however, that the drawings are for the purpose of illustration and description only and are not intended as a definition of the limits of the invention.

BRIEF DESCRIPTION OF THE DRAWINGS

FIG. 1 is a perspective view showing the application of the present invention to a flat bottomed bag;

FIG. 2 is a plan view showing the bag of FIG. 1 after it has been converted to a place mat;

DETAILED DESCRIPTION OF THE PREFERRED EMBODIMENTS

Figure 3:
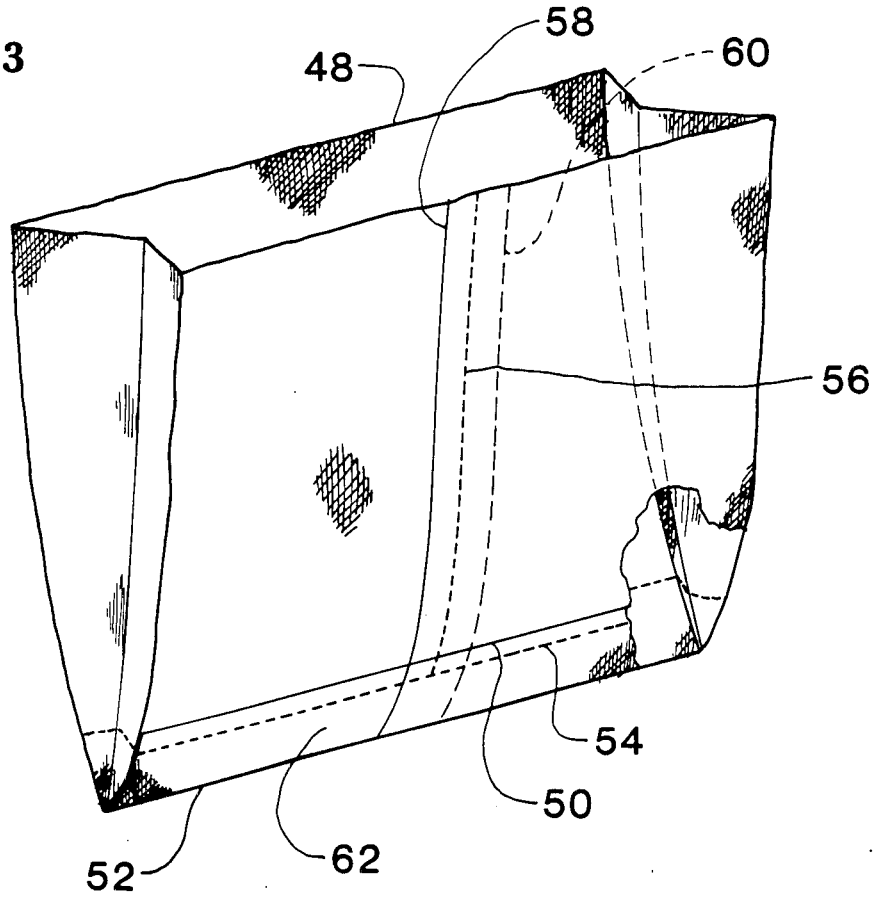
FIG. 3 is a perspective view showing the application of the present invention to a bag having a trough-shaped bottom; and, FIG. 4 is a plan view showing the bag of FIG. 3 after it has been converted to a place mat in accordance with the present invention.

The present invention is fully compatible with the more popular types of bags that are in widespread use today, and the invention will be illustrated by its application to two such conventional bags, as shown in FIGS. 1 and 3.

The type of bag shown in FIG. 1 has four side panels of which the side panel 12 and the side panel 14 are typical. The bag is shown inverted in FIG. 1 so that the bottom 16 of the bag is shown above the open end 28 of the bag. The bottom 16 of the bag is formed by folding inward the flaps 22, 24, then the flap 20 and finally the flap 18. All of these flaps are glued together. Prior to the formation of the bottom 16, the bag has a tubular intermediate form that is produced by overlapping the edges 30, 32 and gluing them together along the strip 26 of double thickness.

In accordance with a first preferred embodiment of the invention that is suitable for bags having rectangular bottoms as illustrated in FIG. 1, a first line of tearing perforations 34 is formed on the side panels 12, 13 and 14 adjacent the bottom 16 of the bag. The first line of tearing perforations 34 includes the segments 38, 40 and 42. Optionally, a fourth segment 44 may be formed along the remaining side panel of the bag. In addition to the first line of tearing perforations 34, a second line of tearing perforations 36 is formed, and it extends from the open end 28 of the bag to the first line of tearing perforations 34.

In the best mode presently known for carrying out the invention, the second line of tearing perforations 36 is formed in the strip of double thickness 26. Because of the extra thickness and the glue, the strip 26 is considerably stronger than the remainder of the side panel 12, and this offsets the weakness caused by the second line of tearing perforations 36.

In an alternative embodiment, a strip of reinforcing tape 46 is applied all the way around the bag at the lowest ends of the side panels before the first line of tearing perforations 34 is formed. The reinforcing tape adds extra strength in the region of the first line of tearing perforations 34 to maintain the strength of the bag. In this case, the perforations serve to indicate and to establish the direction of tearing, but do not serve to reduce the force required to produce the tearing.

It is contemplated that the bag perforated as shown in FIG. 1 would be used for, among other things, holding and carrying take-out foods such as hamburgers, fish and chips, and the like. The customer would normally carry these items to the location where they are to be eaten. Upon arriving there, the user should be able to lay the bag on its side, tear the second line of perforations 36, and then tear the first line of tearing perforations 34. These tearing operations can be done without removing the contents from the bag, if normal care is exercised.

After completing the tearing operations, the user can then lay the bag out flat as shown in FIG. 2. It is noted that the edges 30, 32 are separated, and the bottom 16 has been laid flat. Thus, the bag of FIG. 1 has been converted into the place mat of FIG. 2 which is a single flat sheet having the shape shown in FIG. 2.

FIG. 3 shows the application of the present invention to another type of bag that is widely used. That type of bag is formed by first forming a tube by overlapping the edges 58 and 60. The tube thus formed is cut into segments, each of which will become a bag. The bag is formed by pleating the sides, flattening the structure, and then folding the end 50 of the segment back upon itself to close the bottom 52 of the bag. The resulting bag is shown in FIG. 3.

In accordance with a preferred embodiment of the invention, a first line of tearing perforations 54 is produced across the bag near its bottom. A second line of tearing perforations 56 is also produced, and it extends from the top 48 of the bag to the first line of tearing perforations 54. In the best mode presently known for practicing the invention, the first line of tearing perforations 54 is formed in the double-thickness portion 62 that resulted when the end 50 was folded back on the remainder of the bag. This placement of the first line of tearing perforation 54 results in less weakening of the bag by the perforations. Also in the best mode, the second line of tearing perforation 56 is produced on the double-thickness portion of the bag formed by the overlapping of the edges 58 and 60.

Figure 4:
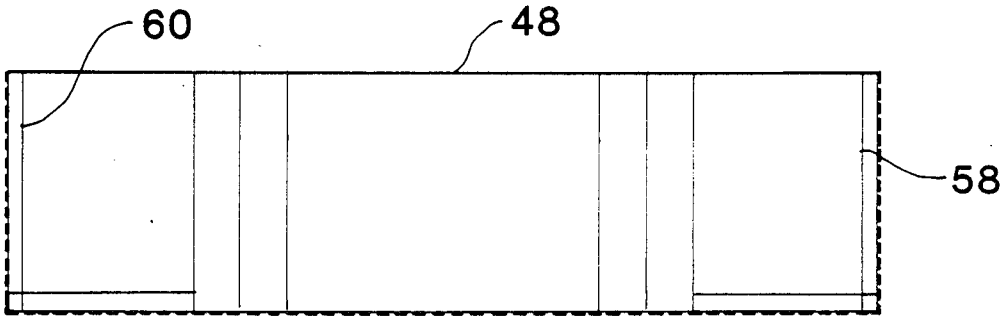

When torn along the first line of tearing perforations 54 and the second line of tearing perforations 56, the bag of FIG. 3 may be laid out flat as shown in FIG. 4.

Although the bags usually used by fast food restaurants usually are made of paper, it will be clear from the foregoing description that the invention may be practiced with bags formed of many other materials including plastic, aluminum foil, and aluminized plastic film among others.

Thus, there have been described two bags that can be converted to place mats by tearing the bags along preformed perforations.

The foregoing detailed description is illustrative of several embodiments of the invention, and it is to be understood that additional embodiments thereof will be obvious to those skilled in the art. The embodiments described herein together with those additional embodiments are considered to be within the scope of the invention.

What is claimed is:

1. In a bag of the type that is formed by overlapping two opposite edges of a rectangular sheet of material to form a tube that includes an overlapped strip, then folding one end portion of the tube back upon itself to form a trough-shaped bottom, the improvement comprising:

a first row of tearing perforations extending through the end portion of the tube that was folded back on itself, adjacent and generally parallel to the trough-shaped bottom; and, a second row of tearing perforations extending within the overlapped strip from said first row of tearing perforations to the open end of the bag, whereby after all of the tearing perforations have been torn, the material of the bag can be spread out flat to serve as a place mat, and this result is achieved without appreciably weakening the bag.

* * * * *